US008192097B2

(12) United States Patent
Ikeda et al.

(10) Patent No.: US 8,192,097 B2
(45) Date of Patent: Jun. 5, 2012

(54) PRINTER APPARATUS

(75) Inventors: Akira Ikeda, Tomi (JP); Masaru Ohnishi, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 78 days.

(21) Appl. No.: 12/955,934

(22) Filed: Nov. 30, 2010

(65) Prior Publication Data

US 2011/0103870 A1 May 5, 2011

Related U.S. Application Data

(63) Continuation of application No. PCT/JP2008/073586, filed on Dec. 25, 2008.

(51) Int. Cl.
*B41J 2/01* (2006.01)
*B41J 19/18* (2006.01)
*B41J 11/66* (2006.01)

(52) U.S. Cl. ..... 400/149; 347/1; 347/2

(58) Field of Classification Search ..... 400/149; 347/1, 2

See application file for complete search history.

(56) References Cited

U.S. PATENT DOCUMENTS 6,164,755 A * 12/2000 Yamamoto ..... 347/37

FOREIGN PATENT DOCUMENTS

JP 09188005 A * 7/1997
JP 09-240097 9/1997
JP 10044518 A * 2/1998
JP 10071710 A * 3/1998
JP 10076729 A * 3/1998
JP 2000218884 A * 8/2000
JP 2005-297248 10/2005
JP 2005297248 A * 10/2005
JP 2006-341420 12/2006
JP 2006341420 A * 12/2006
JP 2007-030253 2/2007

OTHER PUBLICATIONS

International Search Report for International Application No. PCT/JP2008/073586, Jan. 27, 2009.

* cited by examiner

*Primary Examiner* — Judy Nguyen
*Assistant Examiner* — Nguyen Q Ha
(74) *Attorney, Agent, or Firm* — Ditthavong Mori & Steiner, P.C.

(57) ABSTRACT

A printer apparatus includes a first device and a second device. The first device includes a first carriage movable in a scanning direction along a guide rail and a first working device to perform a first predetermined work on an object medium. The second device includes a second carriage movable in the scanning direction along the guide rail and a second working device to perform a second predetermined work on the object medium. A first device holding mechanism is capable of holding the first device. A second device holding mechanism is capable of holding the second device. A vertically retreat mechanism is configured to move the second device holding mechanism and the second device along a vertical direction to be located below a medium supporter to support the object medium when the first working device is moved in the scanning direction to perform the first predetermined work.

20 Claims, 13 Drawing Sheets

BACKGROUND ART

PRINTER APPARATUS

CROSS-REFERENCE TO RELATED APPLICATIONS

The present application is a continuation application of International Application No. PCT/JP2008/073586, filed Dec. 25, 2008. The contents of this application are incorporated herein by reference in their entirety.

BACKGROUND OF THE INVENTION

1. Field of the Invention

The present invention relates to a printer apparatus.

2. Discussion of the background

The above-mentioned printer apparatus (inkjet printer) is structured so that, while a carriage on which a printer head is mounted is relatively moved, for example, in a right and left or lateral direction with respect to a printing medium in a reciprocated manner, ink is ejected from an ejection nozzle formed on an under face of the printer head to perform a predetermined printing on a surface of the printing medium. Printer heads for respective colors of, for example, magenta (M), yellow (Y), cyan (C) and black (K) (hereinafter, these four colors are referred to as "basic color") are mounted on the carriage, inks ejected from the printer heads adhere to the surface of the printing medium with predetermined densities to express various colors.

In recent years, a printer apparatus has been developed in which a cutting device for performing a cutting work on a printing medium in a desired shape is mounted on the printer apparatus so that printing and a cutting work can be performed by one printer apparatus. For example, in FIG. 1 in Japanese Patent Laid-Open No. 2005-297248, a structure is disclosed that the carriage 22 on which the ink-jet heads 26 are mounted and the carriage 24 on which the cutting head 28 is mounted are provided so as to be movable along the guide rail 18 and a desired printing and a desired cutting work are performed on a sheet 100 which is placed on the base member 12.

A part of a printer apparatus 500 is shown in FIG. 13 as an example of a conventional printer apparatus which is structured to be capable of performing printing and a cutting work as described above. The printer apparatus 500 is structured so that a printing device 520 on which a plurality of printer heads 521 is mounted and a cutting device 530 on which a cutter blade 531 is mounted are attached to a guide rail 510, which is provided so as to face a platen 540 on which a printing medium (not shown) is placed and supported, so as to be movable in the right and left direction in the drawing.

When printing is to be performed on a printing medium, the printing device 520 is moved on an upper side of the platen 540 by a drive mechanism not shown and, on the other hand, when a cutting work is to be performed, the cutting device 530 is moved on the upper side of the platen 540. Further, in respective standby states of the printing device 520 and the cutting device 530 which are not operated, they are separately located at right and left positions of the platen 540 as shown in FIG. 13.

Recently, in the printer apparatus in which printing and a cutting work are capable of performing as described above, the printing device 520 and the cutting device 530 have been required to be in a standby state at only one of a right side position or a left side position of the platen 540 from a standpoint of workability in maintenance or the like. In order to attain this requirement, in FIG. 13, for example, in a case that the cutting device 530 is located on the side of the printing device 520 and two devices are held in standby states on the right side end part of the guide rail 510 in the drawing, when the printing device 520 is to be moved to the upper side of the platen 540 for printing, the operation is obstructed by the cutting device 530.

SUMMARY OF THE INVENTION

According to one aspect of the present invention, a printer apparatus includes a medium supporter, a guide rail, a first device, a second device, a first device holding mechanism, a second device holding mechanism, and a vertically retreat mechanism. The medium supporter supports an object medium. The guide rail is provided above the medium supporter to face the medium supporter. The guide rail is relatively movable in a predetermined feeding direction with respect to the object medium supported by the medium supporter. The guide rail extends in a scanning direction perpendicular to the predetermined feeding direction. The first device includes a first carriage and a first working device. The first carriage is movable in the scanning direction along the guide rail. The first working device is mounted on the first carriage to perform a first predetermined work on the object medium. The second device includes a second carriage and a second working device. The second carriage is movable in the scanning direction along the guide rail. The second working device is mounted on the second carriage to perform a second predetermined work on the object medium. The first device holding mechanism is capable of holding the first device and provided on one side in the scanning direction with respect to the medium supporter. The second device holding mechanism is capable of holding the second device and provided between the medium supporter and the first device holding mechanism in the scanning direction. The vertically retreat mechanism is configured to move the second device holding mechanism and the second device held by the second device holding mechanism along a vertical direction perpendicular to the scanning direction to be located below the medium supporter when the first device holding mechanism releases the first device and the first working device is moved in the scanning direction to perform the first predetermined work.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5A shows a state before connected, FIG. 5B shows a state after connected, and FIG. 5C shows a state where the connection has been released;

DESCRIPTION OF THE EMBODIMENTS

Figure 1:
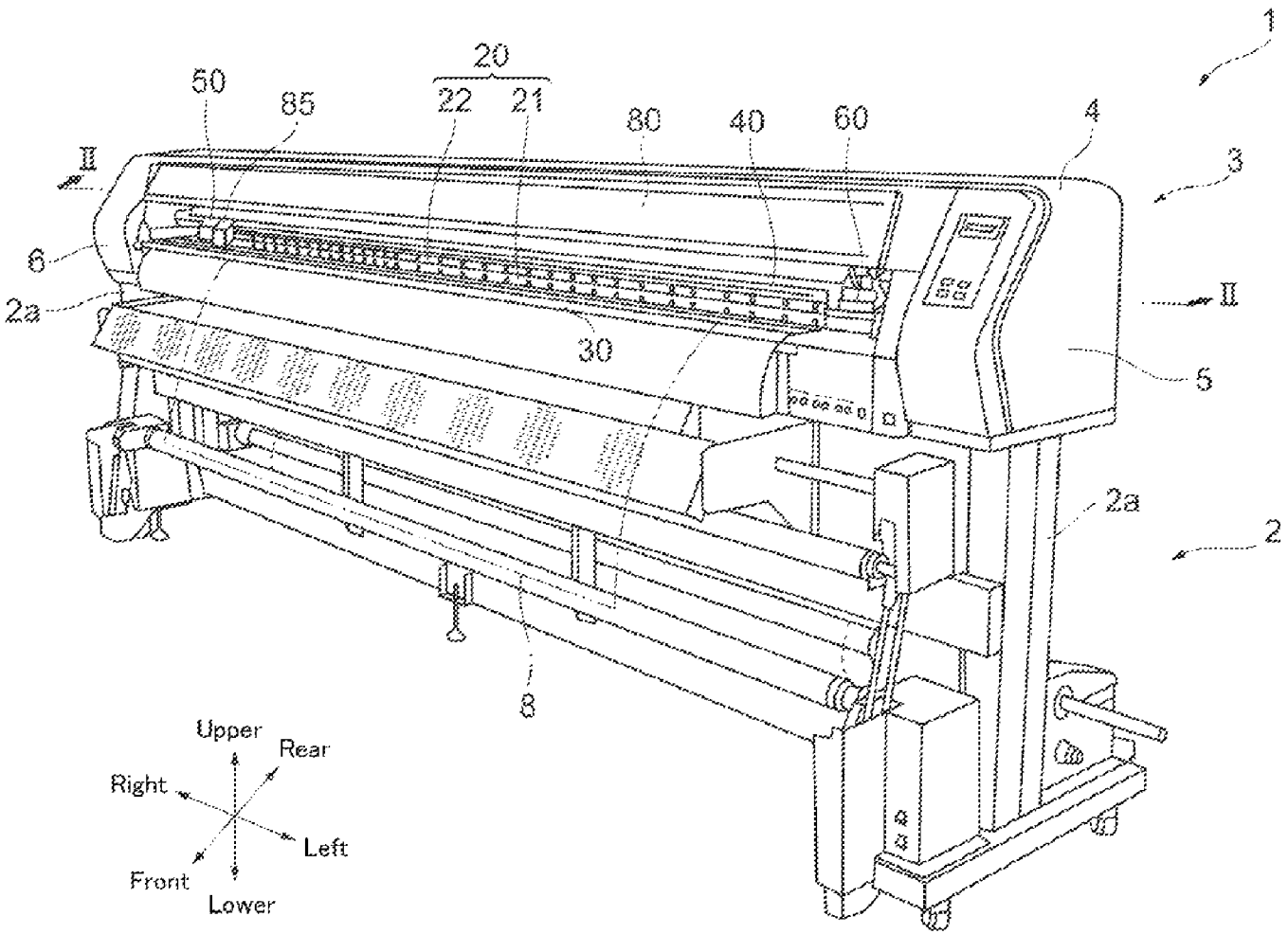
FIG. 1 is a perspective view showing an outward appearance of a printer apparatus in accordance with embodiments of the present invention (first through fourth embodiments)

The embodiments of the present invention will be described below based on first through fourth embodiments with reference to the accompanying drawings, wherein like reference numerals designate corresponding or identical elements throughout the various drawings. In the following description, in convenience of description, arrow directions shown in respective drawings are respectively defined as a front and rear direction, a right and left (lateral) direction and an upper and lower (vertical) direction.

First Embodiment

Figure 2:
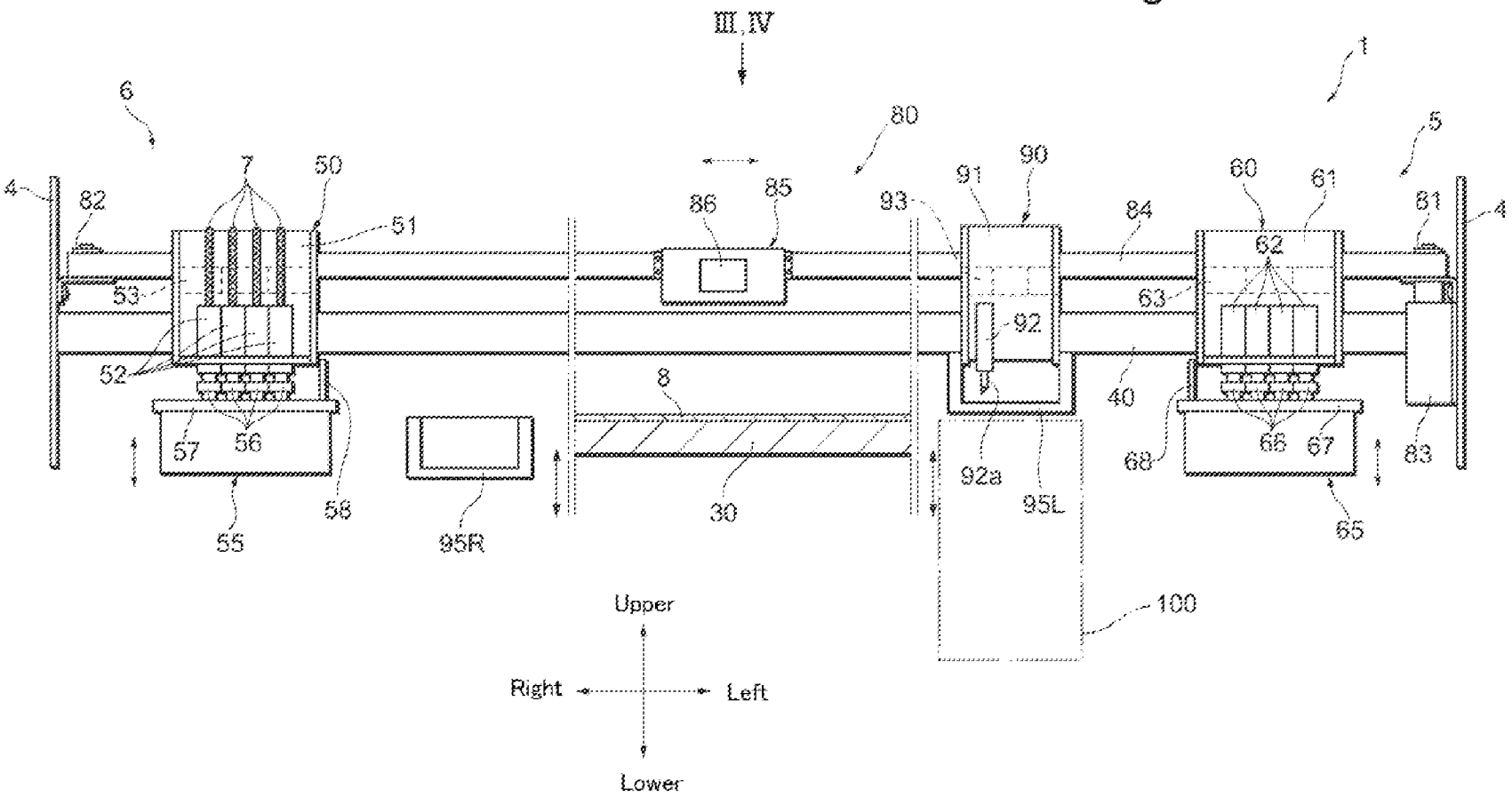
FIG. 2 is a front view showing a vicinity of a guide rail of the printer apparatus.
Figure 3:
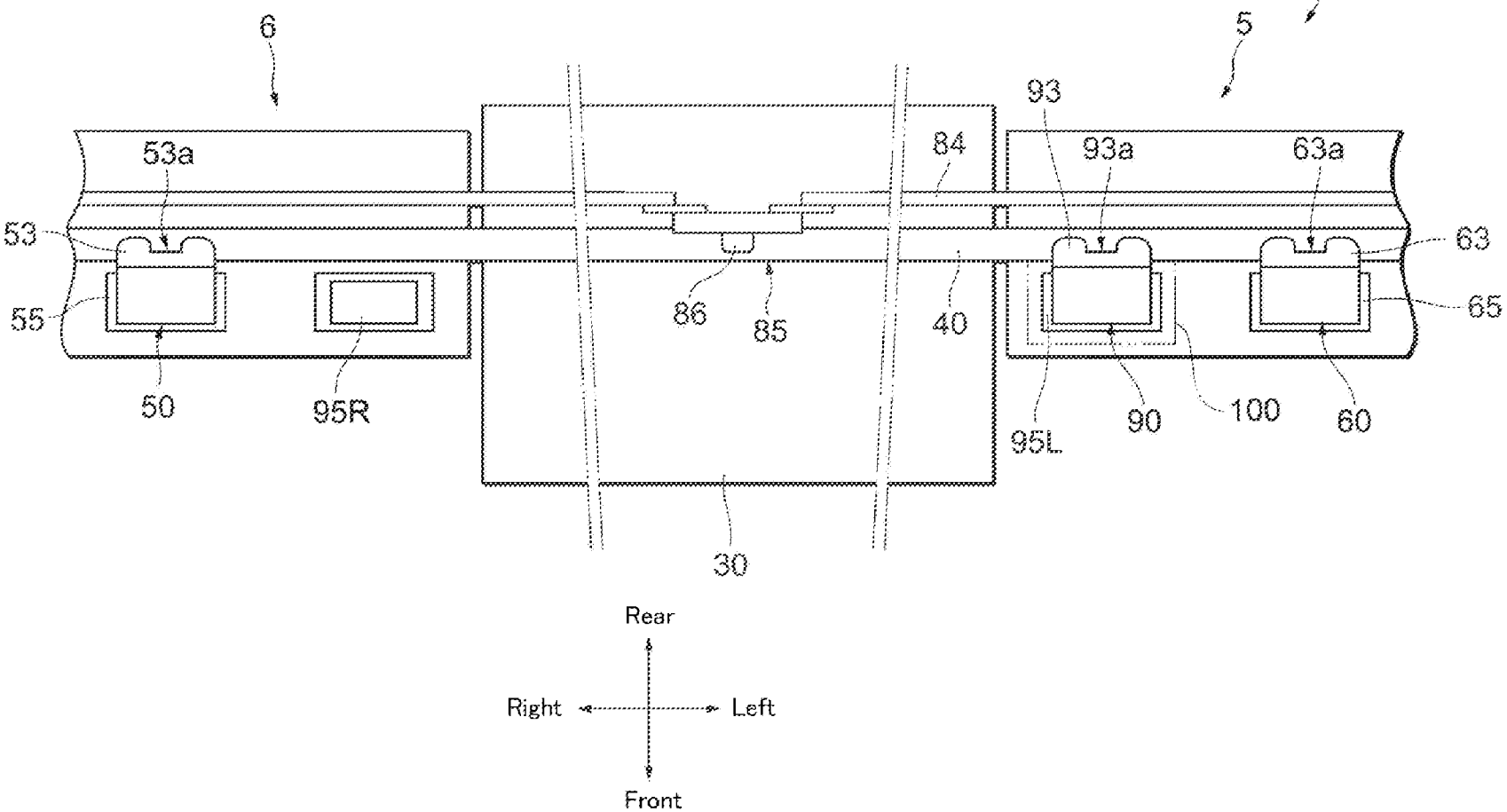
FIG. 3 is a plan view showing a vicinity of the guide rail of the printer apparatus.
Figure 4:
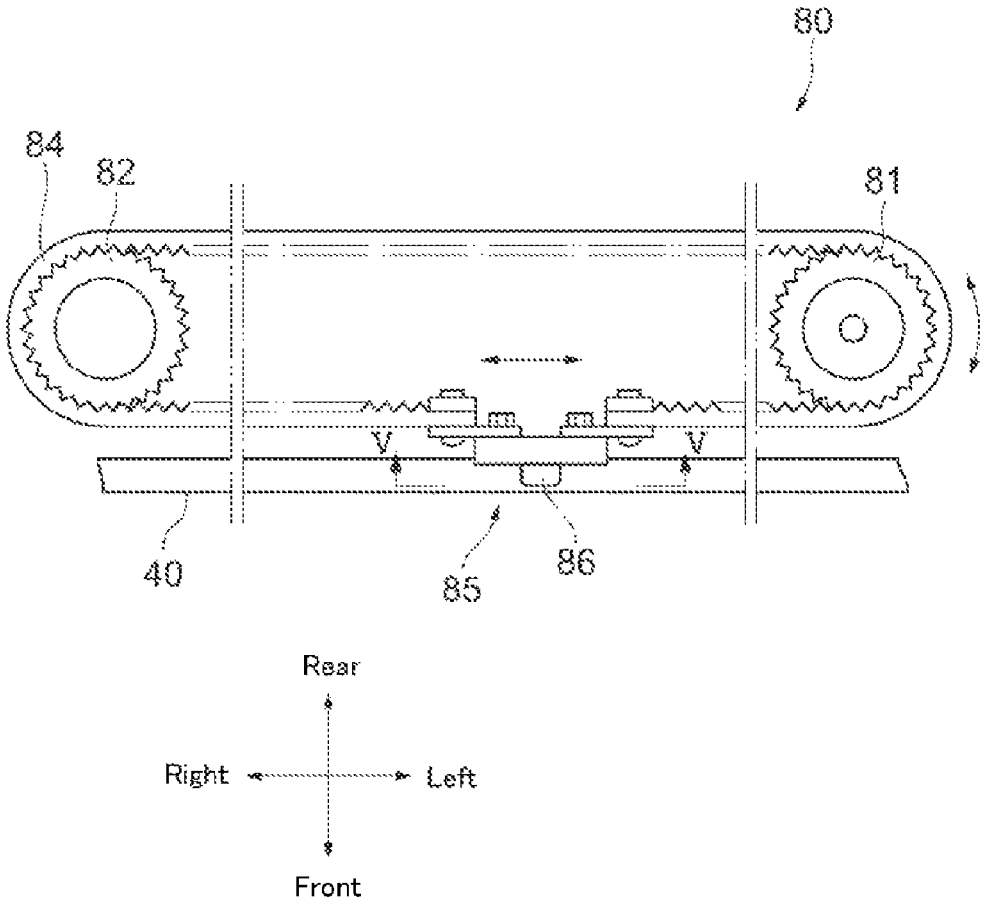
FIG. 4 is a plan view showing a drive device of the printer apparatus.
Figure 5A:
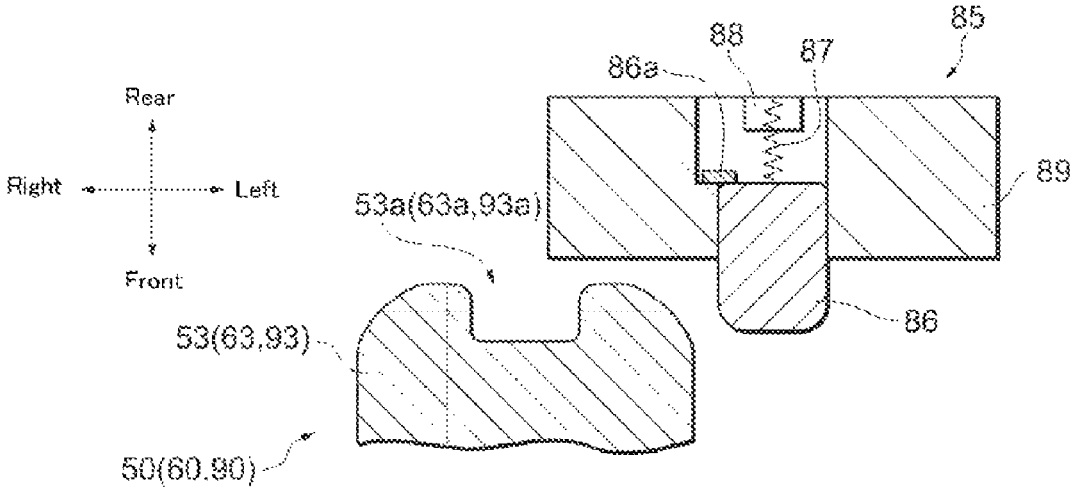
FIGS. 5A, 5B and 5C are cross-sectional views showing connecting states of a drive carriage with a connecting part.
Figure 5B:
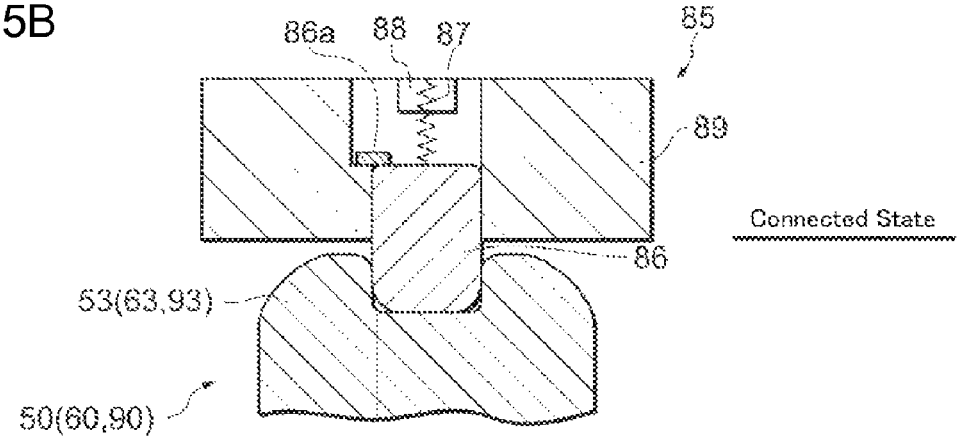
Figure 5C:
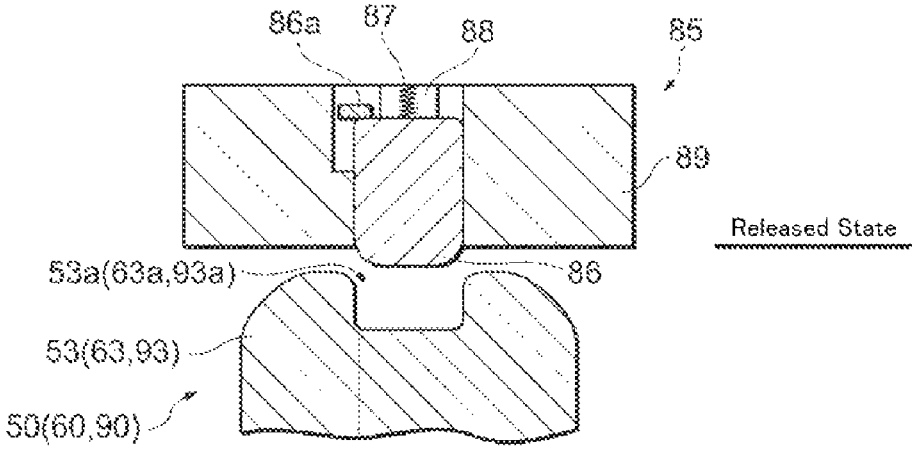
Figure 6:
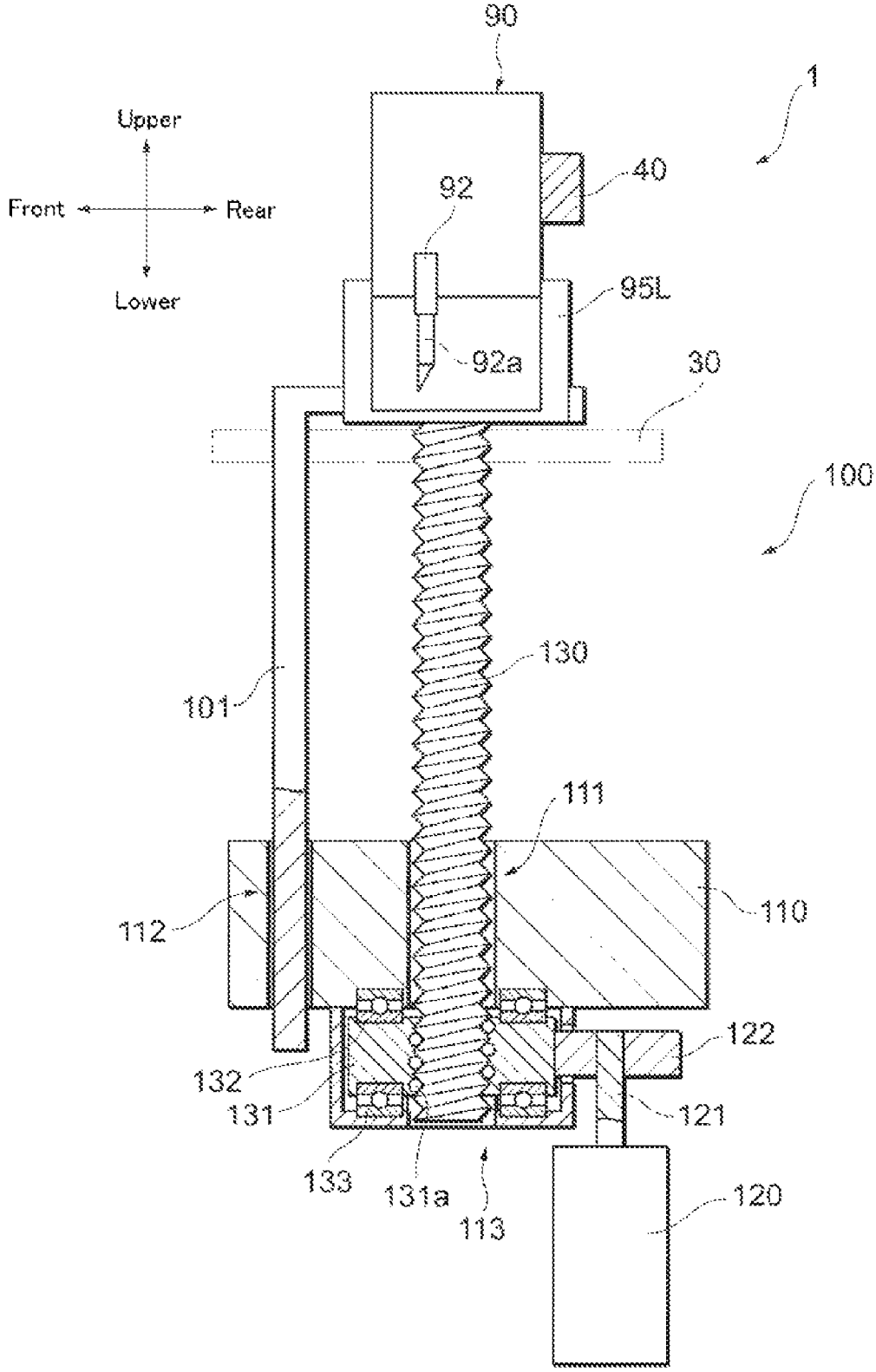
FIG. 6 is a side view showing a vertically moving mechanism (upper side moved state) in accordance with a first embodiment.
Figure 7:
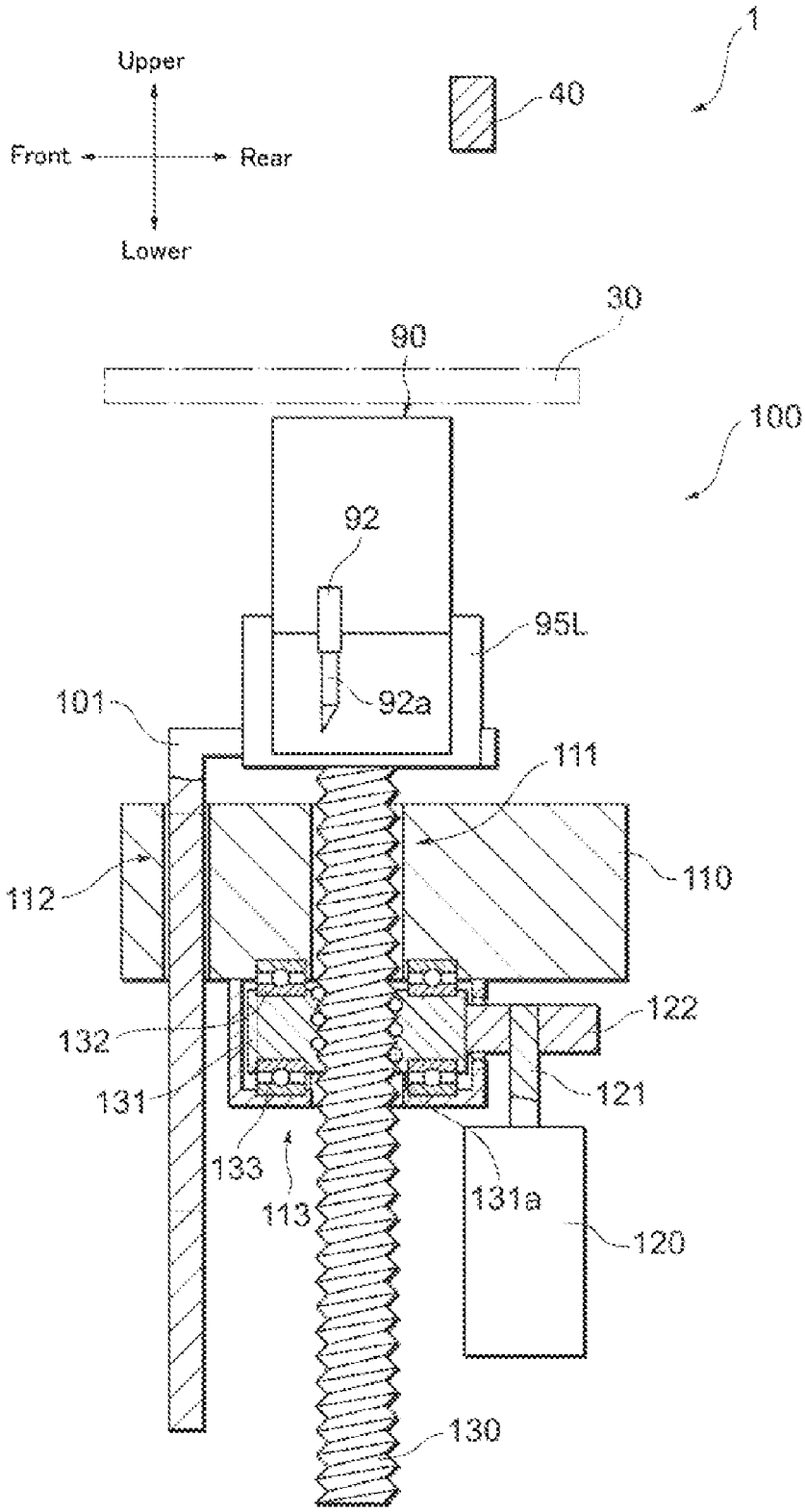
FIG. 7 is a side view showing the vertically moving mechanism (lower side moved state) in accordance with the first embodiment.

A structure of a printer apparatus 1 in accordance with a first embodiment will be described below with reference to FIGS. 1 through 7. FIG. 1 is a perspective view showing a printer apparatus 1, FIGS. 2 and 3 show a vicinity of a guide rail 40 described below, FIG. 4 is a plan view showing a drive device 80 described below, FIGS. 5A, 5B, and 5C are cross-sectional views showing connecting portions of a drive carriage 85 with a connecting part 53 (connecting part 63 and connecting part 93) described below, and FIGS. 6 and 7 show a vertically movable mechanism 100 described below.

1, mainly structured of a main body part 3 which is extended in a right and left direction and a support part 2 which is provided with a pair of legs 2*a* and 2*a* on right and left sides for supporting the main body part 3. A left main body part 5 and a right main body part 6 are respectively formed at right and left end parts of the main body part 3 and their outer peripheral portions are covered with a main body cover 4. An inside of the left main body part 5 is provided with a controller (not shown) which outputs an operation signal to respective structure portions of the printer apparatus 1 described below for controlling their operations.

A feed mechanism 20, a platen 30 which is formed in a flat plate shape for supporting a printing sheet 8 which is an object to be printed, a guide rail 40 which is extended in the right and left direction on an upper side of the platen 30, a first printing device 50 and a second printing device 60, a drive device 80, a cutting device 90 and the like are structured and disposed between the left main body part 5 and the right main body part 6. In FIGS. 2 and 3, a right standby station 95R and a left standby station 95L are provided on a right side and a left side of the platen 30. However, for example, it may be structured that only the right standby station 95L is provided.

The feed mechanism 20 is mainly structured of a plurality of pinch rollers 22 which are rotatably disposed side by side in the right and left direction and a feed roller 21 which is provided on an under side of the pinch rollers 22 and on a rear side of the platen 30. When the feed roller 21 is rotated in a state that a printing sheet 8 is sandwiched between the feed roller 21 and the pinch rollers 22, the printing sheet 8 is fed by a predetermined distance in the front direction and the rear direction.

The first printing device 50 is, as shown in FIG. 2, mainly structured of a carriage 51 which is attached to the guide rail 40 so as to be movable in the right and left direction and a plurality of printer heads 52 which are structured for basic colors such as magenta, yellow, cyan and black. A plate-shaped connecting part 53 whose center portion is formed with a fitting recessed part 53*a* is provided on the rear part of the carriage 51 so as to extend to a rear side (see FIG. 3) and a fitting projection 86 of a drive carriage 85 described below is arranged so as to be capable of fitting to the recessed part 53*a*. The printer heads 52 are mounted on the carriage 51 in a state that a plurality of ejection nozzles (not shown) from which ink is ejected is directed to the lower side. The printer head 52 is connected with an ink cartridge (not shown) which is mounted on the printer apparatus 1 through a tube 7 and ink in the ink cartridge is supplied through the tube 7.

The second printing device 60 is mainly structured of a carriage 61 which is attached to the guide rail 40 so as to be movable in the right and left direction and a plurality of printer heads 62 which are structured for white, metallic, pearl and fluorescent color which are difficult to be simultaneously printed with the basic colors (hereinafter, referred to as special colors to the basic colors). Similarly to the carriage 51, a plate-shaped connecting part 63 whose center portion is formed with a fitting recessed part 63*a* is provided so as to extend to the rear side (see FIG. 3). The printer heads 62 are, similarly to the printer heads 52, mounted on the carriage 61 in a state that a plurality of ejection nozzles (not shown) from which ink is ejected is directed to the lower side. However, different from the printer head 52, the printer heads 52 are respectively structured so that a predetermined quantity of ink is capable of being stored in the inside of the head and mounted on the carriage 61 in a detachable manner.

As shown in FIG. 2, a first maintenance device 55 is provided on a lower side of the guide rail 40 in the right main body part 6 so as to face the first printing device 50 in the upper and lower direction which has been moved to a first maintenance position on the right side of the platen 30. The first maintenance device 55 is structured so that suction caps 56 for covering under faces of the printer heads 52 (face where the ejection nozzle is formed) to prevent from being dried are attached on an upper face of a stage 57 which is movable in the upper and lower direction. Further, the inside of the suction cap 56 is set in a negative pressure in a state that the under face of the printer head 52 is covered so that the ink within the ejection nozzle is sucked and discharged.

As described below, when the first printing device 50 is moved to the first maintenance position, the stage 57 is automatically moved upward and the under faces of the printer heads 52 are covered by the suction caps 56 to prevent the ejection nozzles from being dried. Further, in this case, the suction caps 56 are abutted with the under faces of the printer heads 52 and thus the first printing device 50 is held at the first maintenance position. A left end part of the stage 57 is attached with a wiper 58, which is made of flexible material such as rubber and capable of abutting with the under face of the printer head 52 and movable in the front and rear direction.

A second maintenance device 65 is provided on a lower side of the guide rail 40 in the left main body part 5 so as to face the second printing device 60, which has been moved to a second maintenance position on the left side of the platen 30, in the upper and lower direction. The second maintenance device 65 is, similarly to the first maintenance device 55, attached with suction caps 66 and a wiper 68 on an upper face side of the stage 67 and structured so as to perform similar operations to the first maintenance device 55.

The cutting device 90 is, as shown in FIG. 2, mainly structured of a carriage 91 which is movably attached to the guide rail 40 in the right and left direction and a cutter holder 92 which is mounted on the carriage 91. Similarly to the carriage 51, a plate-shaped connecting part 93 whose center portion is formed with a fitting recessed part 93*a* is provided on the rear side of the carriage 91 so as to extend to the rear side (see FIG. 3). A cutter blade 92*a* is detachably mounted on a lower end part of the cutter holder 92 and movably mounted on the carriage 91 in an upper and lower direction.

The drive device 80 is, as shown in FIG. 2, mainly structured of a drive pulley 81 and a driven pulley 82, which are provided at the right and left end parts of the guide rail 40, a right and left drive motor 83 for rotatably driving the drive pulley 81, a band-shaped toothed drive belt 84 which is stretched over the pulleys 81 and 82, and a drive carriage 85 which is connected with the toothed drive belt 84.

The drive carriage 85 is, as shown in FIGS. 5A, 5B and 5C, mainly structured of a main body part 89, a fitting projection 86 which is inserted into the main body part 89 so as to be movable in the front and rear direction, an urging spring 87 which urges the fitting projection 86 to a front side with respect to the main body part 89, and an electromagnet 88 which is attached to the main body part 89. A front and rear stopper 86*a* is attached to a rear end part of the fitting projection 86. The electromagnet 88 is provided so that generation of its magnetic force is controlled on the basis of an operation signal from the controller.

In this structure, the rotational driving of the right and left drive motor 83 and the magnetic force generation of the electromagnet 88 are controlled by the controller and, in this manner, the first printing device 50, the second printing device 60 and the cutting device 90 are controlled so as to move in the right and left direction along the guide rail 40.

The left standby station 95L is provided on a lower side of the guide rail 40 in the left main body part 5 and faces the cutting device 90 which has been moved to a left standby position on the left side with respect to the platen 30 (left side with respect to the platen 30 and right side with respect to the second maintenance device 65). Further, as shown in FIGS. 6 and 7, the left standby station 95L is provided with a vertically moving mechanism 100 for moving the left standby station 95L in an upper and lower direction.

In a state that the cutting device 90 has been moved to the left standby position, when the left standby station 95L is moved upward by the vertically moving mechanism 100, the left standby station 95L is abutted with an under face of the cutting device 90 to hold the cutting device 90 at the left standby position. The right standby station 95R is structured similarly to the left standby station 95L and provided at a right standby position on the right side with respect to the platen 30 (right side with respect to the platen 30 and left side with respect to the first maintenance device 65).

As shown in FIG. 6, the vertically moving mechanism 100 is mainly structured of a guide member 101 which is connected with the left standby station 95L and extended in an upper and lower direction, a fixed support base 110 which is fixed to a frame member, for example, the leg 2*a* of the printer apparatus 1, a vertically drive motor 120, and a ball screw shaft 130. The fixed support base 110 is structured by using, for example, a flat plate-shaped member and formed with a ball screw shaft hole 111 and a guide hole 112 which are penetrated vertically and a gear housing chamber 113 which is protruded toward lower side from its under face.

A ball screw gear 131 is accommodated in the gear housing chamber 113 in a state that the ball screw gear 131 is sandwiched by an upper bearing 132 and a lower bearing 133 in the upper and lower direction. A plurality of balls 131*a* is rotatably provided on a female screw part (not shown) which is formed on an inner peripheral face of the ball screw gear 131 and an outer gear (not shown) is formed on an outer peripheral face of the ball screw gear 131 to be rotatable in a horizontal plane.

The ball screw shaft 130 is a screw shaft which is formed with a male screw part (not shown) on its outer peripheral face and extended in the upper and lower direction and its upper end part is attached to an under face of the left standby station 95L. Further, the ball screw shaft 130 is inserted into the ball screw shaft hole 111 so as to be capable of moving vertically (upper and lower direction) and the outer peripheral face (male screw part) of the ball screw shaft 130 is fitted with the inner peripheral face (female screw part) of the ball screw gear 131 in the gear housing chamber 113. The vertically drive motor 120 is controlled so as to be driven and rotated by the controller to rotatably drive the ball screw gear 131 through a drive gear 122 which is attached to an output shaft 121. The guide member 101 is inserted into the guide hole 112 of the fixed support base 110 so as to be capable of moving in a vertical direction.

The structure of the printer apparatus 1 has been described above and next, an operation of the respective structural members at the time of printing will be described below.

In the following description, an operation will be described as an example in which, first, printing is performed on a printing sheet 8 by using the basic colors and then, printing using special colors is performed on the printing sheet 8 where printing has been performed by using the basic colors and then, finally, the printing sheet 8 is cut in a desired shape. Before printing is started (standby state), in this example, the drive carriage 85 is not connected with any device as shown in FIG. 2. Further, the first printing device 50 is held at the first maintenance position by the first maintenance device 55, the second printing device 60 is held at the second maintenance position by the second maintenance device 65, and the cutting device 90 is held at the left standby position by the left standby station 95L respectively.

When printing is started by an operator who operates the printer apparatus 1, the drive carriage 85 is moved in the right direction to the first maintenance position and the drive carriage 85 and the first printing device 50 are connected with each other and the first maintenance device 55 is moved down. Next, on an upper side of a printing sheet 8 which is placed on the platen 30, an operation where inks are ejected from the printer heads 52 while the first printing device 50 is moved in the right and left direction in a reciprocated manner and an operation feeding the printing sheet 8 to the front side are performed in a combined manner and, as a result, printing with the use of the basic colors is performed on the printing sheet 8.

When the printing with the use of the basic colors has been finished, the first printing device 50 is moved to the first maintenance position and held by the first maintenance device 55. Next, the drive carriage 85 is to be connected with the second printing device 60 for performing printing with the use of the special colors. However, in this case, since the cutting device 90 is obstructively located on the right side of the second printing device 60, the second printing device 60 is unable to be moved on an upper side of the printing sheet 8 due to the cutting device 90. Therefore, the cutting device 90 and the left standby station 95L are moved down together by the vertically moving mechanism 100, by which the left standby station 95L has been moved upward to hold the cutting device 90 at the left standby position, to retreat from the position so that the second printing device 60 can be moved on an upper side of the printing sheet 8.

More specifically, the vertically drive motor 120 is driven and rotated to rotate the ball screw gear 131 in the horizontal plane through the output shaft 121 and the drive gear 122. In this manner, a downward force is applied to the ball screw shaft 130 which is engaged with the inner peripheral face of the ball screw gear 131 to move the ball screw shaft 130 downward with respect to the fixed support base 110 (ball screw gear 131). In this case, since the guide member 101 is moved downward while being guided by the guide hole 112, the cutting device 90 and the left standby station 95L are straightly moved down without being rotated with the rotation of the ball screw gear 131. As shown in FIG. 7, when the cutting device 90 is moved down to an under side position of the platen 30, the driving of the vertically drive motor 120 is stopped.

In the state shown in FIG. 7, the second printing device 60 connected with the drive carriage 85 is capable of being passed on the upper side of the cutting device 90 to be moved to an upper side of the printing sheet 8 and printing with the use of the special colors can be performed. When printing with the use of the special colors has been finished, the second printing device 60 is passed on the upper side of the cutting device 90 to be moved to the second maintenance position and held by the second maintenance device 65.

After that, the vertically drive motor 120 of the vertically moving mechanism 100 is driven and rotated in the opposite direction to the above-mentioned operation and the cutting device 90 and the left standby station 95L are moved upward together and the carriage 91 is fitted to the guide rail 40 (see FIG. 6). After that, the cutting device 90 which is in a movable state along the guide rail 40 is connected with the drive carriage 85 and then, the left standby station 95L is moved down, for example, to the lower side of the platen 30 by the vertically moving mechanism 100 to release the cutting device 90 which has been held by the left standby station 95L.

As a result, the cutting device 90 can be moved on an upper side of the printing sheet 8 to cut the printing sheet 8 in a desired shape. When the cutting work has been finished, the cutting device 90 is moved to the left standby position and held by the left standby station 95L which is moved upward by the vertically moving mechanism 100 and a series of printings and a cutting work to the printing sheet 8 has finished.

As described above, in the printer apparatus 1 in accordance with the embodiment of the present invention, the cutting device 90 set in a standby state on the platen 30 side can be retreated and located on the lower side of the platen 30 by the vertically moving mechanism 100 as needed. Therefore, even when two devices, i.e., the second printing device 60 and the cutting device 90 are structured so as to be in standby states on the left side of the platen 30, the second printing device 60 can be moved on the upper side of the printing sheet 8 to perform printing.

In addition, for example, in a case that two devices, i.e., the first printing device 50 and the cutting device 90 are mounted on the guide rail 40, these two devices are set in standby states on the left side of the platen 30. In this case, an operator is capable of immediately performing an operation on the printer apparatus 1 and maintenance or the like to the first printing device 50 (cutting device 90) without changing his or her position and thus workability can be improved.

Second Embodiment

Figure 8:
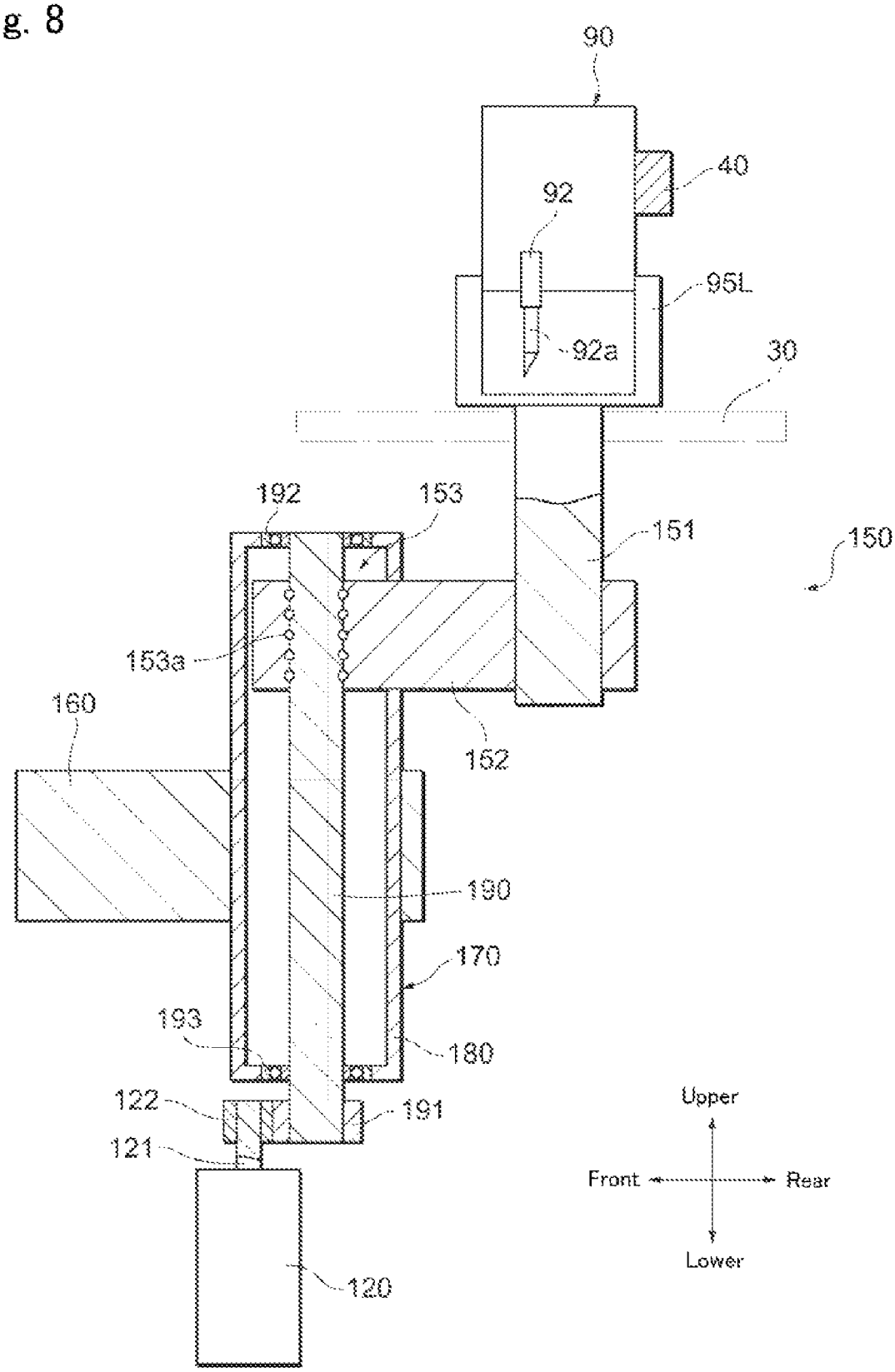
FIG. 8 is a side view showing a vertically moving mechanism (upper side moved state) in accordance with a second embodiment.
Figure 9:
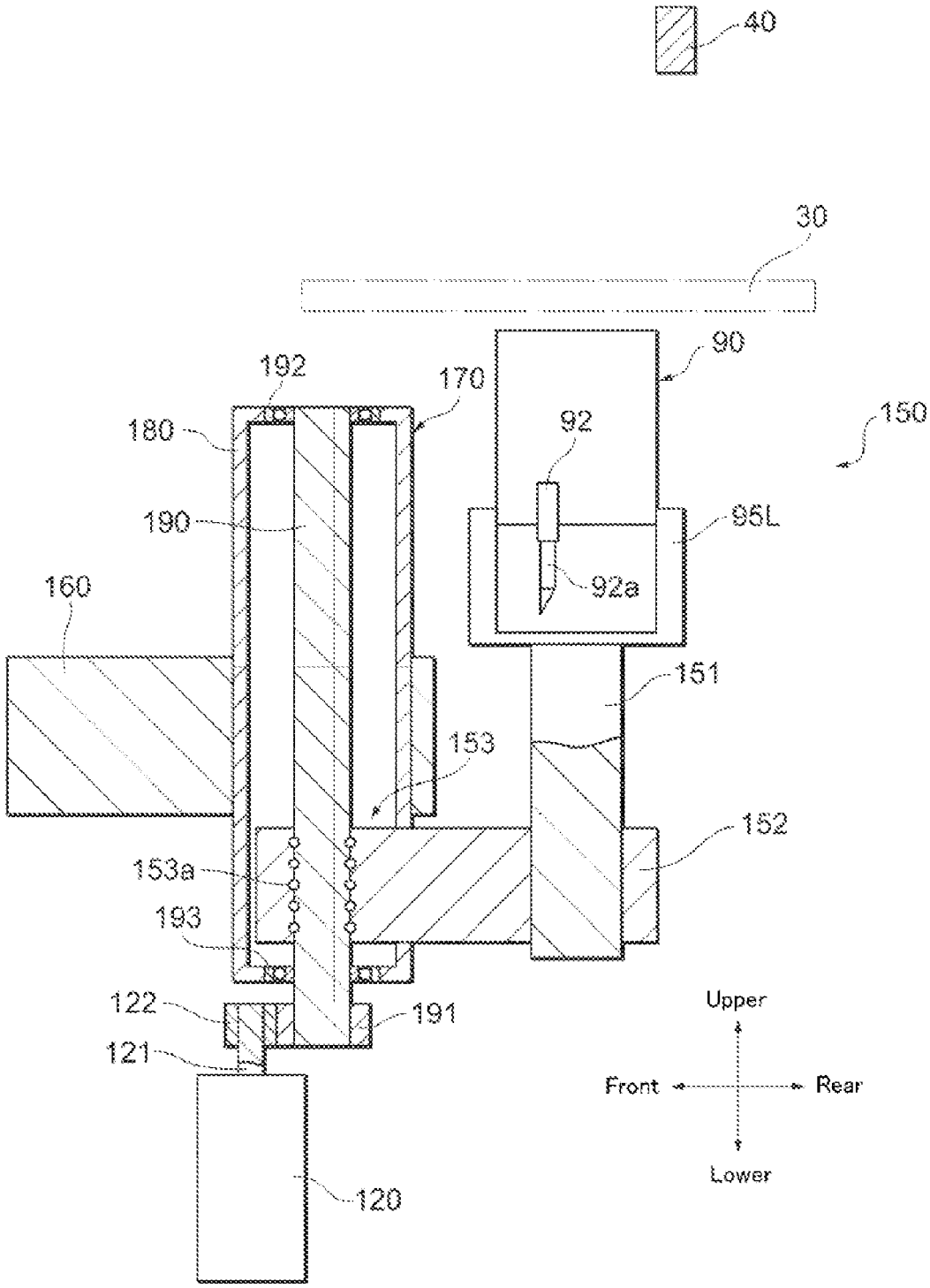
FIG. 9 is a side view showing the vertically moving mechanism (lower side moved state) in accordance with the second embodiment.

Next, a vertically moving mechanism 150 will be described below with reference to FIGS. 8 and 9 as another embodiment of the vertically moving mechanism 100 in the printer apparatus 1 in accordance with the first embodiment. The same reference numbers are used for the members described in the first embodiment and their descriptions are omitted. FIG. 8 shows a state that the cutting device 90 is held by the left standby station 95L and FIG. 9 shows a state that the cutting device 90 has been moved down and retreated respectively.

The vertically moving mechanism 150 is, as shown in FIG. 8, mainly structured of a vertically support member 151 which is connected with the left standby station 95L and extended in a lower direction, a lateral support member 152 which is connected with a lower part of the vertically support member 151 and extended in a lateral direction, a fixed support base 160 which is fixed to a frame member of the printer apparatus 1 such as the leg 2*a*, a vertically drive motor 120 and a vertically conveyance device 170. The vertically conveyance device 170 is structured so that, for example, a ball spiral shaft 190 whose outer peripheral face is formed with a spiral groove in the upper and lower direction is accommodated in the inside of a housing frame 180. An upper end part of the ball spiral shaft 190 is supported by an upper bearing 192 and its lower end part is supported by a lower bearing 193 and thus the ball spiral shaft 190 is rotatably supported. Further, a lower part of the ball spiral shaft 190 is protruded from the housing frame 180 to the lower side and the protruded portion is attached with a driven gear 191 whose outer peripheral face is formed with an outer gear (not shown). In accordance with an embodiment, a device which has been put on the market as a general purpose product may be used as the vertically conveyance device 170.

The fixed support base 160 is, for example, structured by using a flat plate-shaped member and the vertically conveyance device 170 is fixed to the fixed support base 160. The front part of the lateral support member 152 is inserted into the housing frame 180 in a vertically movable manner and an insertion hole 153 which is penetrated in the upper and lower direction is formed in a front end part of the lateral support member 152. A plurality of balls 153*a* is rotatably provided on an inner peripheral face of the insertion hole 153 and the ball spiral shaft 190 is inserted into the insertion hole 153 and the balls 153*a* are fitted with the spiral groove of the ball spiral shaft 190.

The structure of the vertically moving mechanism 150 has been described as described above. Next, an operation will be described below in which, in a state that the left standby station 95L is moved upward and the cutting device 90 is held at the left standby position as shown in FIG. 8, the cutting device 90 and the left standby station 95L are retreated so that the second printing device 60 can be moved to an upper side of a printing sheet 8.

In the state shown in FIG. 8, the vertically drive motor 120 is driven and rotated to rotate the driven gear 191 and the ball spiral shaft 190 through the output shaft 121 and the drive gear 122. As a result, a downward force is applied to the lateral support member 152 which is engaged with the ball spiral shaft 190 and the lateral support member 152 is moved downward with respect to the fixed support base 160 (ball spiral shaft 190). Therefore, the vertically support member 151 connected with the lateral support member 152, the left standby station 95L and the cutting device 90 are moved down together until the cutting device 90 is located on a lower side of the platen 30. When the cutting device 90 is moved down until the cutting device 90 is located on the lower side of the platen 30 as shown in FIG. 9, the driving of the vertically drive motor 120 is stopped. In this manner, the cutting device 90 and the left standby station 95L are retreated.

According to the structure of the printer apparatus 1 with the use of the vertically moving mechanism 150 as described above, in addition to the effects of the first embodiment, since the vertically conveyance device 170 is structured by using a device which has been generally put on the market, the manufacturing cost of the printer apparatus 1 can be reduced in total.

Third Embodiment

Figure 10:
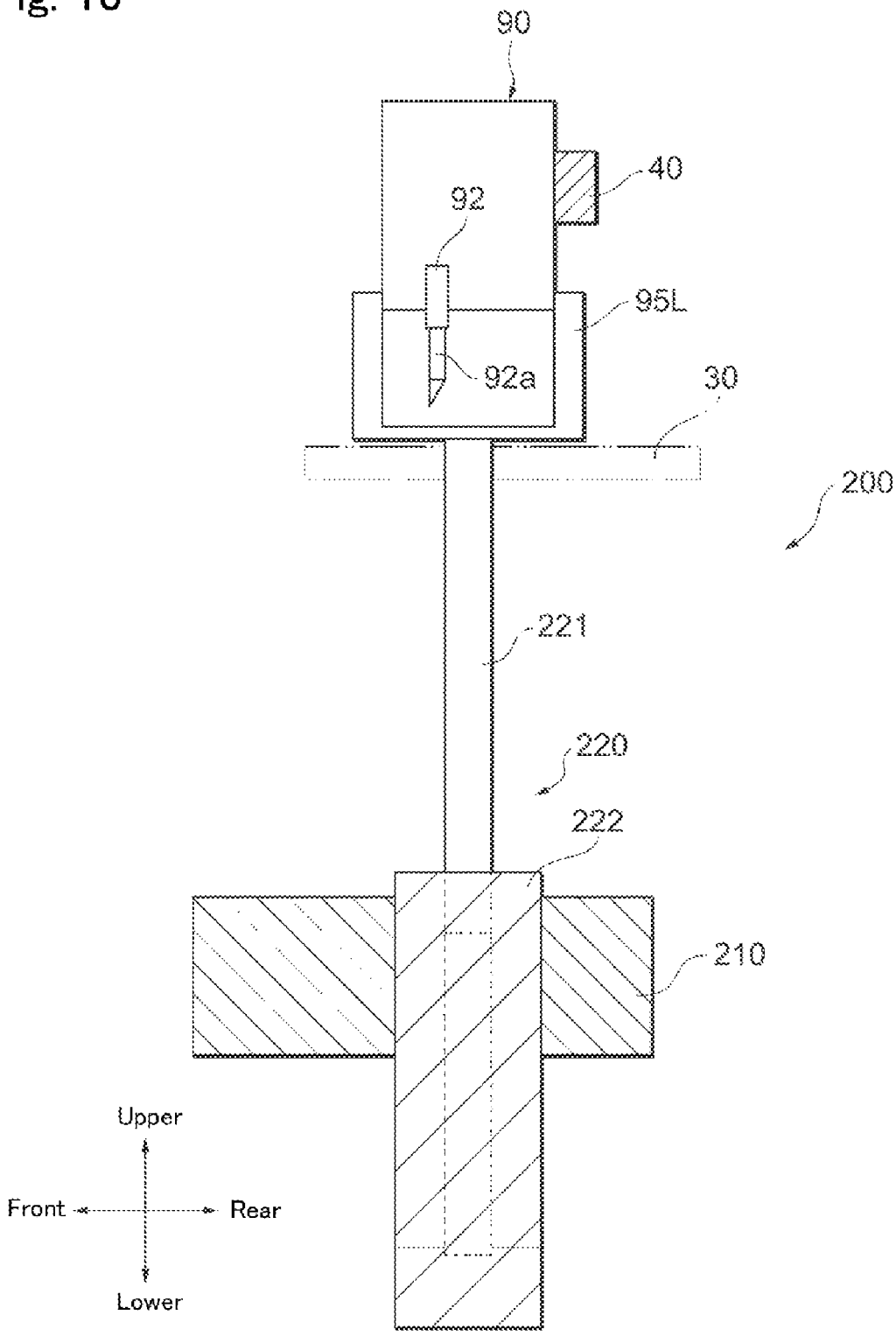
FIG. 10 is a side view showing a vertically moving mechanism (upper side moved state) in accordance with a third embodiment.
Figure 11:
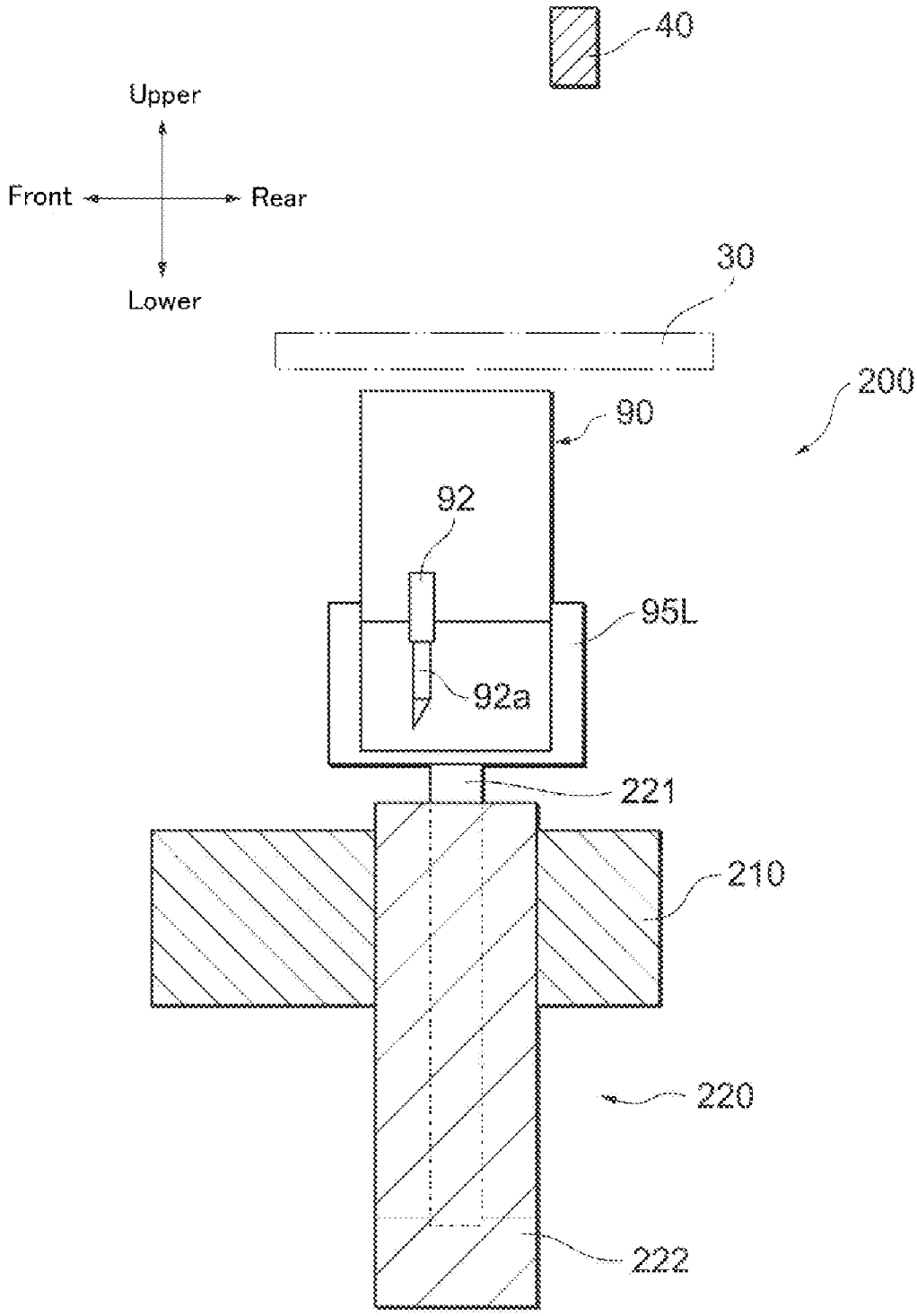
FIG. 11 is a side view showing the vertically moving mechanism (lower side moved state) in accordance with the third embodiment.

Next, a vertically moving mechanism 200 will be described below with reference to FIGS. 10 and 11 as another embodiment of the vertically moving mechanism 100 in the printer apparatus 1 in accordance with the first embodiment. The same reference numbers are used for the members described in the first embodiment and their descriptions are omitted. FIG. 10 shows a state that the cutting device 90 is held by the left standby station 95L and FIG. 11 shows a state that the cutting device 90 has been moved down and retreated respectively.

The vertically moving mechanism 200 is, as shown in FIG. 10, structured by using an air cylinder 220 and an upper end part of a cylinder rod 221 is attached to the left standby station 95L and a cylinder main body 222 is fixed to a fixed support base 210. In a state that the left standby station 95L is moved upward by the vertically moving mechanism 200 to hold the cutting device 90 (see FIG. 10), when the cutting device 90 is to be retreated in the lower direction, the cylinder rod 221 extended to an upper side is pulled down and the cutting device 90 is located on an under side of the platen 30. In this manner, the cutting device 90 and the left standby station 95L are retreated.

According to the structure of the printer apparatus 1 with the use of the vertically moving mechanism 200 as described above, in addition to the effects of the first embodiment, since the number of the structure members of the vertically moving mechanism is reduced, the manufacturing cost of the printer apparatus 1 can be reduced in total.

Fourth Embodiment

Figure 12:
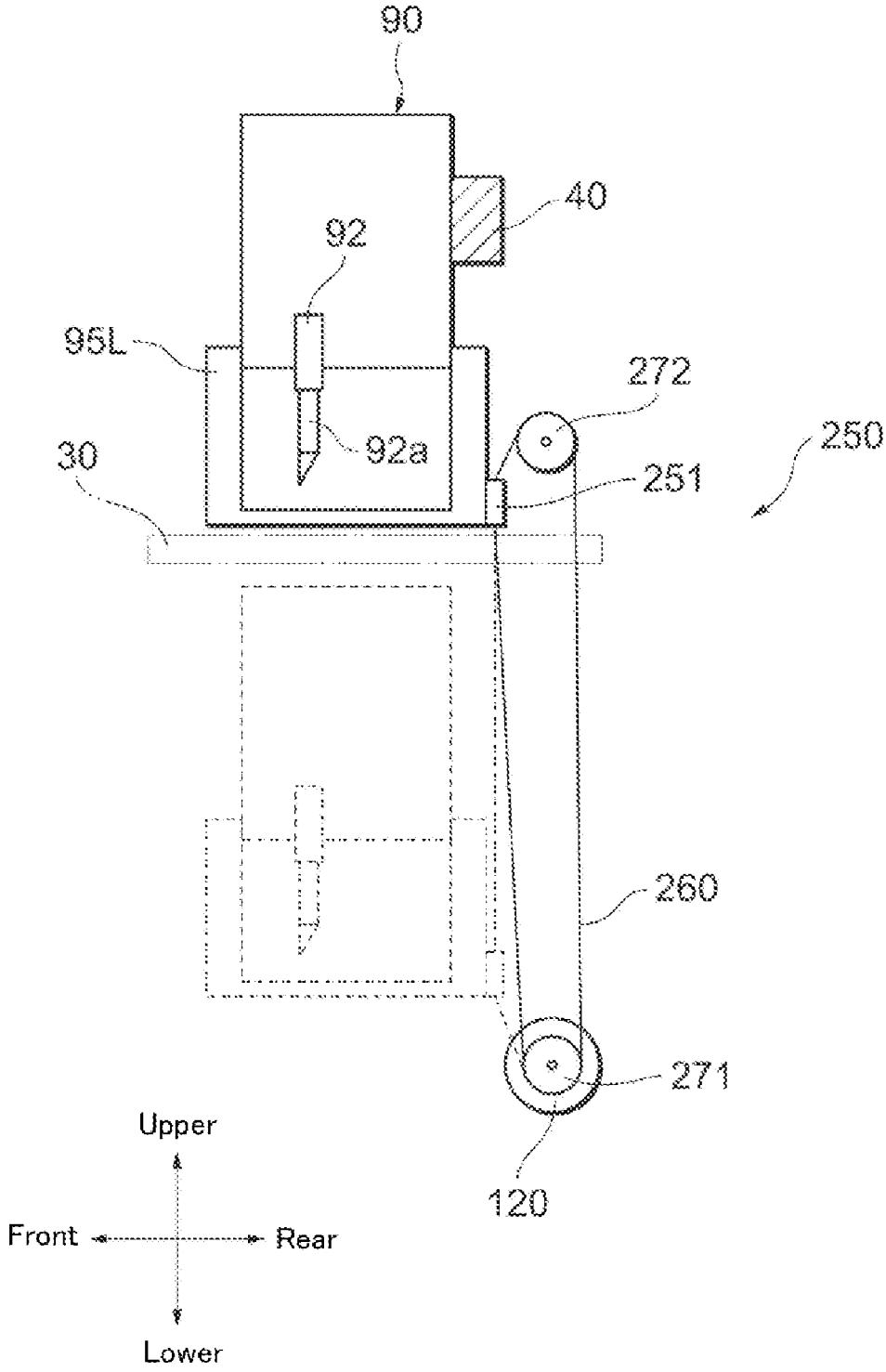
FIG. 12 is a side view showing a vertically moving mechanism in accordance with a fourth embodiment.
Figure 13:
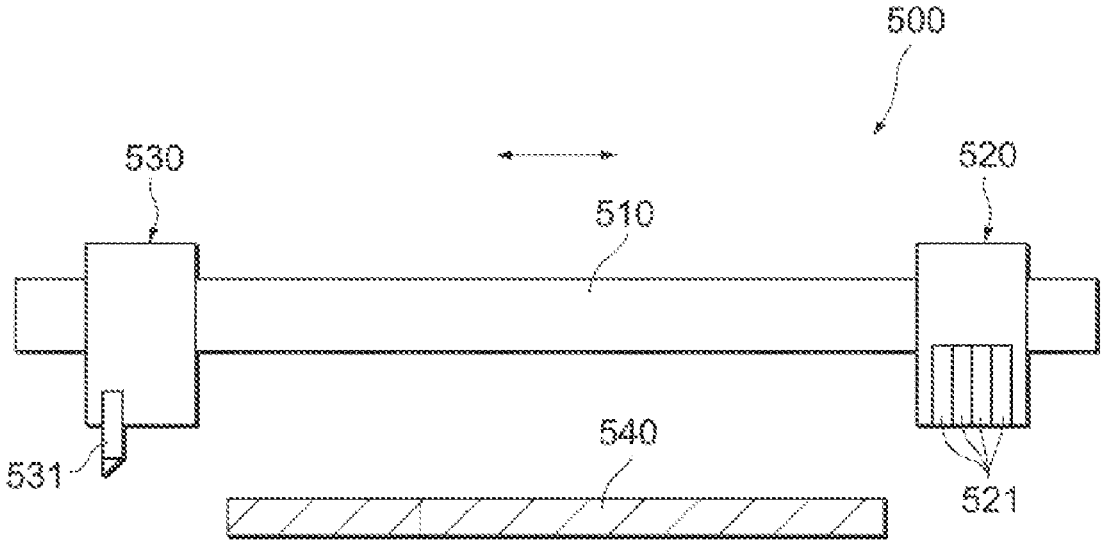
FIG. 13 is a front view showing a part of a conventional printer apparatus.

Next, a vertically moving mechanism 250 will be described below with reference to FIG. 12 as another embodiment of the vertically moving mechanism 100 in the printer apparatus 1 in accordance with the first embodiment. The same reference numbers are used for the members described in the first embodiment and their descriptions are omitted. In FIG. 12, a state where the cutting device 90 is held by the left standby station 95L is shown by the solid line and a state where the cutting device 90 has been moved down and retreated is shown by the dotted line respectively.

The vertically moving mechanism 250 is, as shown in FIG. 12, mainly structured of a vertically drive motor 120, a drive pulley 271 connected with the vertically drive motor 120, a driven pulley 272 which is disposed on an upper side of the drive pulley 271 so as to be paired with the drive pulley 271, and a moving belt 260 which is stretched over the drive pulley 271 and the driven pulley 272. The moving belt 260 is attached to a connection part 251 which is formed at a rear part of the left standby station 95L.

According to this structure, in the state shown by the solid line in FIG. 12, when the cutting device 90 is to be moved down and retreated, the vertically drive motor 120 is driven and rotated to move down the left standby station 95L and the cutting device 90 through the moving belt 260.

According to the structure of the printer apparatus 1 with the use of the vertically moving mechanism 250 as described above, in addition to the effects of the first embodiment, although the mechanism is structured by using simple and inexpensive structure members (drive pulley 271, driven pulley 272 and moving belt 260 and the like), a vertical position of the left standby station 95L is controlled with a high degree of accuracy.

In the embodiments described above, the structures in which the cutting device 90 is moved down and retreated are described as an example. However, the present invention is not limited to this structure. For example, one of the vertically moving mechanisms described above may be attached to the first maintenance device 55 to make the first printing device 50 move down and retreat, or one of the vertically moving mechanisms described above may be attached to the second maintenance device 65 to make the second printing device 60 retreat.

In the embodiments described above, as shown in FIG. 2, the first maintenance device 55 and the right standby station 95R are arranged on the right side with respect to the platen 30 and the second maintenance device 65 and the left standby station 95L are arranged on the left side with respect to the platen 30, but the present invention is not limited to this structure. The printing device and the cutting device (maintenance device and standby station) may be arbitrarily arranged on either side with respect to the platen 30. Further, for example, when a maintenance device and a standby station are disposed on one of the right and left sides with respect to the platen 30, one of the vertically moving mechanisms described above may be attached to the maintenance device or the standby station which is disposed on the side of the platen 30.

In the embodiment described above, the present invention is applied to a printer apparatus in one axis printing sheet moving type and one axis printing device moving type but the present invention is not limited to this structure. The present invention may be applied to another type of a printer apparatus, for example, a printer apparatus in two axes printing device moving type (flat bed type) or in two axes printing sheet moving type. Further, the inks which are used are not limited to a dye-based ink or a pigment-based ink and the present invention may be applied to a printer apparatus in which, for example, an ultraviolet curing type ink is used.

In the printer apparatus according to the embodiment of the present invention, it is preferable that the first device is a head device (for example, the second printing device 60 in the embodiment) which is provided with a head carriage (for example, the carriage 61 in the embodiment) that is movable in the scanning direction along the guide rail and a printer head that is mounted on the head carriage for ejecting ink to the object medium, and the second device is a cutter device (for example, the cutting device 90 in the embodiment) which is provided with a cutter carriage (for example, the carriage 91 in the embodiment) that is movable in the scanning direction along the guide rail and a cutter (for example, the cutter holder 92 in the embodiment) that is mounted on the cutter carriage for performing a cutting work on the object medium in a predetermined shape.

Further, it is also preferable that the first device is a cutter device which is provided with a cutter carriage that is movable in the scanning direction along the guide rail and a cutter that is mounted on the cutter carriage for performing a cutting work on the object medium in a predetermined shape, and the second device is a head device which is provided with a head carriage that is movable in the scanning direction along the guide rail and a printer head that is mounted on the head carriage and from which ink is ejected to the object medium.

In addition, it may be also structured that each of the first device and the second device is a head device which is provided with a head carriage that is movable in the scanning direction along the guide rail and a printer head that is mounted on the head carriage and from which ink is ejected to the object medium.

It is preferable that the vertically retreat mechanism is provided with a grooved shaft (for example, the ball screw shaft 130 in the embodiment) whose outer peripheral face is formed with a spiral groove part and which is vertically extended and attached to the second device holding mechanism, a fitted rotation member (for example, the ball screw gear 131 in the embodiment) whose inner peripheral face is formed with a spiral groove part capable of being fitted to the outer peripheral face of the grooved shaft and which is accommodated in an inside of a fixed support part (for example, the fixed support base 110 in the embodiment) provided on a lower side of the second device holding mechanism in a rotatably supported state in a horizontal plane so that the inner peripheral face is fitted with the outer peripheral face of the grooved shaft for supporting the grooved shaft, and a drive motor (for example, the vertically drive motor 120 in the embodiment) which is capable of rotationally driving the fitted rotation member.

In this structure, a force is applied in an upper direction and a lower direction to the grooved shaft which is fitted to the fitted rotation member by means of that the drive motor is rotated to rotate the fitted rotation member so that the second device holding mechanism and the second device are vertically moved with respect to the fixed support part.

It is also preferable that the vertically retreat mechanism is provided with a vertically conveyance device which accommodates a grooved shaft whose outer peripheral face is formed with a spiral groove part so as to be vertically extended, which rotatably supports the grooved shaft, and which is attached to a fixed support part provided on a lower side of the second device holding mechanism, a moving support member (for example, the vertically support member 151 and the lateral support member 152 in the embodiment) which is attached to the second device holding mechanism for supporting the second device holding mechanism and, in which a fitted part that is formed with a spiral groove part capable of fitting to the outer peripheral face of the grooved shaft is fitted with the grooved shaft so as to be capable of being vertically moved with respect to the vertically conveyance device, and a drive motor which is capable of rotationally driving the grooved shaft.

In this structure, a force is applied in an upper direction and a lower direction to the moving support member which is fitted with the grooved shaft by means of that the drive motor is rotated to rotate the grooved shaft so that the second device holding mechanism and the second device are vertically moved with respect to the fixed support part.

Further, it may be also structured that the vertically retreat mechanism is provided with a piston device (for example, the air cylinder 220 in the embodiment) whose one end is attached to a fixed support part provided on a lower side of the second device holding mechanism and whose other end is attached to the second device holding mechanism, and the piston device is disposed so as to be capable of being extended and retreated in an upper and lower direction, and the second device holding mechanism and the second device are vertically moved with respect to the fixed support part by the piston device which is extended and retreated.

In addition, it is also preferable that the vertically retreat mechanism is provided with a pair of pulleys (for example, the drive pulley 271 and the driven pulley 272 in the embodiment) which are disposed at an upper position and a lower position, an endless conveyance belt (for example, the moving belt 260 in the embodiment) which is stretched over the pair of the pulleys so as to be extended in an upper and lower direction and connected with the second device holding mechanism, and a drive motor which is capable of rotationally driving one of the pair of the pulleys. In this structure, the endless conveyance belt which is stretched over the pair of the pulleys is moved in the upper and lower direction by the drive motor that is rotated so that the second device holding mechanism and the second device are vertically moved with respect to the pair of the pulleys.

The printer apparatus in accordance with the embodiment of the present invention is structured so that, when a predetermined working is to be performed while the first working device is moved in the scanning direction, the second device and the second device holding mechanism are moved to be located at a lower position with respect to the medium supporter by the vertically retreat mechanism. According to this structure, even when the first device and the second device are set in standby states on the same side in the scanning direction with respect to the medium supporter, since the second device which is located nearer to the medium supporter is retreated by the vertically retreat mechanism as needed, working to the object medium by the first device is prevented from being obstructed by the second device. Further, since a plurality of devices are capable of being set in standby states on one side with respect to the platen, for example, an operator is capable of simultaneously performing maintenance or the like on the plurality of the devices and thus workability can be improved.

In the printer apparatus according to the embodiment of the present invention, it is preferable that the first device is a head device which is provided with a printer head for ejecting ink to an object medium and the second device is a cutter device which is provided with a cutter for performing a cutting work on the object medium in a predetermined shape. According to this structure, when the cutter device is vertically moved by the vertically retreat mechanism, since the number of wiring lines, piping lines and the like of the cutter device is commonly smaller in comparison with that of the head device, the structure of the device relating to wiring lines, piping lines and the like can be made simple.

On the other hand, it is also preferable that the first device is a cutter device which is provided with a cutter for performing a cutting work on an object medium in a predetermined shape and the second device is a head device which is provided with a printer head for ejecting ink to the object medium. According to this structure, for example, in a case that use frequency of the head device is higher than that of the cutter device, the number of times of the head device which is vertically moved by the vertically retreat mechanism is reduced to shorten the working time and thus the working efficiency can be improved.

In addition, it is also preferable that each of the first device and the second device is a head device which is provided with a printer head for ejecting ink to an object medium. For example, when a printer head for ink which is hardly used at the time of normal printing is mounted on the first device and printer heads for basic colors are mounted on the second device, the vertical movement by the vertically retreat mechanism is not required at the time of normal printing with the use of the basic colors and thus the printing can be performed efficiently.

Further, it is preferable that the vertically retreat mechanism is structured so that a drive motor is rotated to rotate a fitted rotation member which is fitted with a grooved shaft and a force is applied to the grooved shaft fitted with the fitted rotation member in an upper direction and a lower direction to vertically move the second device with respect to the fixed support part. According to this structure, the second device can be moved in the upper and lower direction with a high degree of accuracy by the drive motor whose driving and rotating are controlled and thus, for example, holding of the second device by the second device holding mechanism and retreating of the second device by the second device holding mechanism can be performed surely.

Further, it is also preferable that the vertically retreat mechanism is structured by using a vertically conveyance device which is provided with a rotatable grooved shaft and which is attached to a fixed support part, and the vertically retreat mechanism is structured so that a drive motor is rotated to rotate the grooved shaft and a force is applied to a moving support member supporting the second device holding mechanism in an upper direction and a lower direction to vertically move the second device with respect to the fixed support part. According to this structure, a vertically conveyance device which has been put on the market as an inexpensive general purpose product may be used and thus a manufacturing cost of the printer apparatus can be reduced as a whole.

In addition, it is also preferable that the vertically retreat mechanism is structured by using the piston device which is disposed so as to be capable of being extended and retreated in an upper and lower direction. In this case, when the piston device is simply extended, the second device can be held by the second device holding mechanism and, when the piston device is simply retreated, the second device can be retreated by the second device holding mechanism and thus the device and operation for the vertically retreat mechanism can be structured to be simple.

It is also desirable that the vertically retreat mechanism is structured so that a drive motor is rotated to vertically move an endless conveyance belt which is stretched over a pair of pulleys to vertically move the second device. According to this structure, although the mechanism using the pulleys and the endless conveyance belt is simple and inexpensive, the second device can be moved with a high degree of accuracy and, for example, the second device is held by the second device holding mechanism and the second device is retreated by the second device holding mechanism surely.

Obviously, numerous modifications and variations of the present invention are possible in light of the above teachings. It is therefore to be understood that within the scope of the appended claims, the invention may be practiced otherwise than as specifically described herein.

The invention claimed is:

1. A printer apparatus comprising:

a medium supporter to support an object medium;

a guide rail which is provided above the medium supporter to face the medium supporter and which is relatively movable in a predetermined feeding direction with respect to the object medium supported by the medium supporter, the guide rail extending in a scanning direction perpendicular to the predetermined feeding direction;

a first device comprising:

a first carriage movable in the scanning direction along the guide rail; and a first working device mounted on the first carriage to perform a first predetermined work on the object medium;

a second device comprising:

a second carriage movable in the scanning direction along the guide rail; and a second working device mounted on the second carriage to perform a second predetermined work on the object medium;

a first device holding mechanism capable of holding the first device and provided on one side in the scanning direction with respect to the medium supporter;

a second device holding mechanism capable of holding the second device and provided between the medium supporter and the first device holding mechanism in the scanning direction; and a vertically retreat mechanism configured to move the second device holding mechanism and the second device held by the second device holding mechanism along a vertical direction perpendicular to the scanning direction to be located below the medium supporter when the first device holding mechanism releases the first device and the first working device is moved in the scanning direction to perform the first predetermined work.

2. The printer apparatus according to claim 1, wherein the first device comprises a head device comprising:

a head carriage movable in the scanning direction along the guide rail; and a printer head that is mounted on the head carriage and from which ink is ejected to the object medium; and wherein the second device comprises a cutter device comprising:

a cutter carriage that is movable in the scanning direction along the guide rail; and a cutter that is mounted on the cutter carriage to perform a cutting work on the object medium in a predetermined shape.

3. The printer apparatus according to claim 1, wherein the first device comprises a cutter device comprising:

a cutter carriage movable in the scanning direction along the guide rail; and a cutter that is mounted on the cutter carriage for performing a cutting work on the object medium in a predetermined shape; and wherein the second device comprises a head device comprising:

a head carriage that is movable in the scanning direction along the guide rail;

a printer head that is mounted on the head carriage and from which ink is ejected to the object medium.

4. The printer apparatus according to claim 1, wherein each of the first device and the second device comprises a head device comprising:

a head carriage that is movable in the scanning direction along the guide rail; and a printer head that is mounted on the head carriage and from which ink is ejected to the object medium.

5. The printer apparatus according to claim 1, wherein the vertically retreat mechanism comprises a grooved shaft whose outer peripheral face is formed with a spiral groove part and which is attached to the second device holding mechanism to vertically extend, a fitted rotation member whose inner peripheral face is formed with a spiral groove part capable of being fitted to the outer peripheral face of the grooved shaft and which is accommodated in an inside of a fixed support part provided on a lower side of the second device holding mechanism in a rotatably supported state in a horizontal plane so that the inner peripheral face is fitted with the outer peripheral face of the grooved shaft to support the grooved shaft, and a drive motor capable of rotationally driving the fitted rotation member, and wherein a force is applied in an upper direction and a lower direction to the grooved shaft which is fitted to the fitted rotation member by means of that the drive motor is rotated to rotate the fitted rotation member so that the second device holding mechanism and the second device are vertically moved with respect to the fixed support part.

6. The printer apparatus according to claim 1, wherein the vertically retreat mechanism comprises a vertically conveyance device which accommodates a grooved shaft whose outer peripheral face is formed with a spiral groove part so as to be vertically extended, which rotatably supports the grooved shaft, and which is attached to a fixed support part provided on a lower side of the second device holding mechanism, a moving support member which is attached to the second device holding mechanism to support the second device holding mechanism and, in which a fitted part that is formed with a spiral groove part capable of fitting to the outer peripheral face of the grooved shaft is fitted with the grooved shaft so as to be capable of being vertically moved with respect to the vertically conveyance device, and a drive motor capable of rotationally driving the grooved shaft, and wherein a force is applied in an upper direction and a lower direction to the moving support member which is fitted with the grooved shaft by means of that the drive motor is rotated to rotate the grooved shaft so that the second device holding mechanism and the second device are vertically moved with respect to the fixed support part.

7. The printer apparatus according to claim 1, wherein the vertically retreat mechanism comprises a piston device whose one end is attached to a fixed support part provided on a lower side of the second device holding mechanism and whose another end is attached to the second device holding mechanism, the piston device being disposed so as to be capable of being extended and retreated in an upper and lower direction, and wherein the second device holding mechanism and the second device are vertically moved with respect to the fixed support part by the piston device which is extended or retreated.

8. The printer apparatus according to claim 1, wherein the vertically retreat mechanism comprises a pair of pulleys disposed at an upper position and a lower position respectively, an endless conveyance belt which is stretched over the pair of the pulleys so as to be extended in an upper and lower direction and which is connected with the second device holding mechanism, and a drive motor which capable of rotationally driving one of the pair of the pulleys, and wherein the endless conveyance belt stretched over the pair of the pulleys is moved in the upper and lower direction by the drive motor which is rotated so that the second device holding mechanism and the second device are vertically moved with respect to the pair of the pulleys.

9. The printer apparatus according to claim 2, wherein the vertically retreat mechanism comprises a grooved shaft whose outer peripheral face is formed with a spiral groove part and which is attached to the second device holding mechanism to vertically extend, a fitted rotation member whose inner peripheral face is formed with a spiral groove part capable of being fitted to the outer peripheral face of the grooved shaft and which is accommodated in an inside of a fixed support part provided on a lower side of the second device holding mechanism in a rotatably supported state in a horizontal plane so that the inner peripheral face is fitted with the outer peripheral face of the grooved shaft to support the grooved shaft, and a drive motor capable of rotationally driving the fitted rotation member, and wherein a force is applied in an upper direction and a lower direction to the grooved shaft which is fitted to the fitted rotation member by means of that the drive motor is rotated to rotate the fitted rotation member so that the second device holding mechanism and the second device are vertically moved with respect to the fixed support part.

10. The printer apparatus according to claim 3, wherein the vertically retreat mechanism comprises a grooved shaft whose outer peripheral face is formed with a spiral groove part and which is attached to the second device holding mechanism to vertically extend, a fitted rotation member whose inner peripheral face is formed with a spiral groove part capable of being fitted to the outer peripheral face of the grooved shaft and which is accommodated in an inside of a fixed support part provided on a lower side of the second device holding mechanism in a rotatably supported state in a horizontal plane so that the inner peripheral face is fitted with the outer peripheral face of the grooved shaft to support the grooved shaft, and a drive motor capable of rotationally driving the fitted rotation member, and wherein a force is applied in an upper direction and a lower direction to the grooved shaft which is fitted to the fitted rotation member by means of that the drive motor is rotated to rotate the fitted rotation member so that the second device holding mechanism and the second device are vertically moved with respect to the fixed support part.

11. The printer apparatus according to claim 4, wherein the vertically retreat mechanism comprises a grooved shaft whose outer peripheral face is formed with a spiral groove part and which is attached to the second device holding mechanism to vertically extend, a fitted rotation member whose inner peripheral face is formed with a spiral groove part capable of being fitted to the outer peripheral face of the grooved shaft and which is accommodated in an inside of a fixed support part provided on a lower side of the second device holding mechanism in a rotatably supported state in a horizontal plane so that the inner peripheral face is fitted with the outer peripheral face of the grooved shaft to support the grooved shaft, and a drive motor capable of rotationally driving the fitted rotation member, and wherein a force is applied in an upper direction and a lower direction to the grooved shaft which is fitted to the fitted rotation member by means of that the drive motor is rotated to rotate the fitted rotation member so that the second device holding mechanism and the second device are vertically moved with respect to the fixed support part.

12. The printer apparatus according to claim 2, wherein the vertically retreat mechanism comprises a vertically conveyance device which accommodates a grooved shaft whose outer peripheral face is formed with a spiral groove part so as to be vertically extended, which rotatably supports the grooved shaft, and which is attached to a fixed support part provided on a lower side of the second device holding mechanism, a moving support member which is attached to the second device holding mechanism to support the second device holding mechanism and, in which a fitted part that is formed with a spiral groove part capable of fitting to the outer peripheral face of the grooved shaft is fitted with the grooved shaft so as to be capable of being vertically moved with respect to the vertically conveyance device, and a drive motor capable of rotationally driving the grooved shaft, and wherein a force is applied in an upper direction and a lower direction to the moving support member which is fitted with the grooved shaft by means of that the drive motor is rotated to rotate the grooved shaft so that the second device holding mechanism and the second device are vertically moved with respect to the fixed support part.

13. The printer apparatus according to claim 3, wherein the vertically retreat mechanism comprises a vertically conveyance device which accommodates a grooved shaft whose outer peripheral face is formed with a spiral groove part so as to be vertically extended, which rotatably supports the grooved shaft, and which is attached to a fixed support part provided on a lower side of the second device holding mechanism, a moving support member which is attached to the second device holding mechanism to support the second device holding mechanism and, in which a fitted part that is formed with a spiral groove part capable of fitting to the outer peripheral face of the grooved shaft is fitted with the grooved shaft so as to be capable of being vertically moved with respect to the vertically conveyance device, and a drive motor capable of rotationally driving the grooved shaft, and wherein a force is applied in an upper direction and a lower direction to the moving support member which is fitted with the grooved shaft by means of that the drive motor is rotated to rotate the grooved shaft so that the second device holding mechanism and the second device are vertically moved with respect to the fixed support part.

14. The printer apparatus according to claim 4, wherein the vertically retreat mechanism comprises a vertically conveyance device which accommodates a grooved shaft whose outer peripheral face is formed with a spiral groove part so as to be vertically extended, which rotatably supports the grooved shaft, and which is attached to a fixed support part provided on a lower side of the second device holding mechanism, a moving support member which is attached to the second device holding mechanism to support the second device holding mechanism and, in which a fitted part that is formed with a spiral groove part capable of fitting to the outer peripheral face of the grooved shaft is fitted with the grooved shaft so as to be capable of being vertically moved with respect to the vertically conveyance device, and a drive motor capable of rotationally driving the grooved shaft, and wherein a force is applied in an upper direction and a lower direction to the moving support member which is fitted with the grooved shaft by means of that the drive motor is rotated to rotate the grooved shaft so that the second device holding mechanism and the second device are vertically moved with respect to the fixed support part.

15. The printer apparatus according to claim 2, wherein the vertically retreat mechanism comprises a piston device whose one end is attached to a fixed support part provided on a lower side of the second device holding mechanism and whose another end is attached to the second device holding mechanism, the piston device being disposed so as to be capable of being extended and retreated in an upper and lower direction, and wherein the second device holding mechanism and the second device are vertically moved with respect to the fixed support part by the piston device which is extended or retreated.

16. The printer apparatus according to claim 3, wherein the vertically retreat mechanism comprises a piston device whose one end is attached to a fixed support part provided on a lower side of the second device holding mechanism and whose another end is attached to the second device holding mechanism, the piston device being disposed so as to be capable of being extended and retreated in an upper and lower direction, and wherein the second device holding mechanism and the second device are vertically moved with respect to the fixed support part by the piston device which is extended or retreated.

17. The printer apparatus according to claim 4, wherein the vertically retreat mechanism comprises a piston device whose one end is attached to a fixed support part provided on a lower side of the second device holding mechanism and whose another end is attached to the second device holding mechanism, the piston device being disposed so as to be capable of being extended and retreated in an upper and lower direction, and wherein the second device holding mechanism and the second device are vertically moved with respect to the fixed support part by the piston device which is extended or retreated.

18. The printer apparatus according to claim 2, wherein the vertically retreat mechanism comprises a pair of pulleys disposed at an upper position and a lower position respectively, an endless conveyance belt which is stretched over the pair of the pulleys so as to be extended in an upper and lower direction and which is connected with the second device holding mechanism, and a drive motor which capable of rotationally driving one of the pair of the pulleys, and wherein the endless conveyance belt stretched over the pair of the pulleys is moved in the upper and lower direction by the drive motor which is rotated so that the second device holding mechanism and the second device are vertically moved with respect to the pair of the pulleys.

19. The printer apparatus according to claim 3, wherein the vertically retreat mechanism comprises a pair of pulleys disposed at an upper position and a lower position respectively, an endless conveyance belt which is stretched over the pair of the pulleys so as to be extended in an upper and lower direction and which is connected with the second device holding mechanism, and a drive motor which capable of rotationally driving one of the pair of the pulleys, and wherein the endless conveyance belt stretched over the pair of the pulleys is moved in the upper and lower direction by the drive motor which is rotated so that the second device holding mechanism and the second device are vertically moved with respect to the pair of the pulleys.

20. The printer apparatus according to claim 4, wherein the vertically retreat mechanism comprises a pair of pulleys disposed at an upper position and a lower position respectively, an endless conveyance belt which is stretched over the pair of the pulleys so as to be extended in an upper and lower direction and which is connected with the second device holding mechanism, and a drive motor which capable of rotationally driving one of the pair of the pulleys, and wherein the endless conveyance belt stretched over the pair of the pulleys is moved in the upper and lower direction by the drive motor which is rotated so that the second device holding mechanism and the second device are vertically moved with respect to the pair of the pulleys.

* * * * *